US011187021B2

(12) United States Patent
Gherardi

(10) Patent No.: US 11,187,021 B2
(45) Date of Patent: Nov. 30, 2021

(54) HINGE DEVICE WITH DAMPENING OF END STROKES

(71) Applicant: C.M.I. CERNIERE MECCANICHE INDUSTRIALI S.R.L., Valsamoggia (IT)

(72) Inventor: Eros Gherardi, Bologna (IT)

(73) Assignee: C.M.I. Cerniere Meccaniche Industriali S.R.L.

( * ) Notice: Subject to any disclaimer, the term of this patent is extended or adjusted under 35 U.S.C. 154(b) by 0 days.

(21) Appl. No.: 16/772,414

(22) PCT Filed: Dec. 14, 2018

(86) PCT No.: PCT/EP2018/084951
§ 371 (c)(1),
(2) Date: Jun. 12, 2020

(87) PCT Pub. No.: WO2019/121391
PCT Pub. Date: Jun. 27, 2019

(65) Prior Publication Data

US 2021/0071456 A1 Mar. 11, 2021

(30) Foreign Application Priority Data

Dec. 18, 2017 (IT) ..... 102017000146007

(51) Int. Cl.
*E05F 3/20* (2006.01)
*E05F 1/12* (2006.01)
*E05F 3/04* (2006.01)

(52) U.S. Cl.
CPC ..... *E05F 3/20* (2013.01); *E05F 1/1261* (2013.01); *E05F 3/04* (2013.01); *E05Y 2201/21* (2013.01);
(Continued)

(58) Field of Classification Search
CPC ... E05F 3/20; E05F 1/1261; E05F 3/04; E05F 5/02; E05Y 2201/21; E05Y 2900/30; E05Y 2900/208
See application file for complete search history.

(56) References Cited

U.S. PATENT DOCUMENTS 8,806,719 B2 * 8/2014 Kleeman ..... E05F 1/1261 16/286
9,080,365 B2 * 7/2015 Collene ..... E05F 1/1261
(Continued)

FOREIGN PATENT DOCUMENTS

DE 20 2007 012 603 U1 2/2009
EP 2 474 786 A2 7/2012

OTHER PUBLICATIONS

Bibliographic data, EP2474786A2, including English Abstract, 3 pages.

(Continued)

*Primary Examiner* — Victor D Batson
*Assistant Examiner* — Matthew J Sullivan
(74) *Attorney, Agent, or Firm* — Ware, Fressola, Maguire & Barber LLP

(57) ABSTRACT

A hinged device with dampening of the opening (A) and/or closing (C) end strokes of a door of an appliance includes a first element (3) to be fixed to a body and a second element (5) to be fixed to the door of the appliance and hinged by a hinge pin (7) so that the door rotates along the opening (A) and closing (C) end strokes and an intermediate (I) stroke around the hinge pin (7). The device includes a cradle (11) sliding into the first element (3) and a connecting rod (13) connected to the cradle (11) and to the second element (5) for translation, following the door rotation, of the cradle (11) that slidably houses a damper (21) of variable length and provided with sliding members (25, 27) sliding into first
(Continued)

slots (31) of the cradle (11) and into second slots (33) of the first element (3).

10 Claims, 5 Drawing Sheets

(52) U.S. Cl.
CPC ..... *E05Y 2201/264* (2013.01); *E05Y 2800/45* (2013.01); *E05Y 2800/674* (2013.01); *E05Y 2900/30* (2013.01)

(56) References Cited

U.S. PATENT DOCUMENTS

| | | | | |
|---|---|---|---|---|
| 9,181,741 | B2 * | 11/2015 | Bettinzoli | E05F 1/1261 |
| 9,840,862 | B2 * | 12/2017 | Kadus | E05D 7/00 |
| 10,053,902 | B1 * | 8/2018 | White | E05F 3/10 |
| 10,082,298 | B2 * | 9/2018 | White | F24C 15/023 |
| 2011/0148262 | A1 * | 6/2011 | Basavalingappa Mudbasal | F24C 15/023 312/319.2 |
| 2016/0348919 | A1 * | 12/2016 | Ivanovic | E05C 3/14 |
| 2019/0383081 | A1 * | 12/2019 | Thielmann | E05D 11/0054 |

OTHER PUBLICATIONS

International Search Report, Application No. PCT/EP2018/084951, dated Mar. 8, 2019, 3 pages.
Written Opinion of the ISA, Application No. PCT/EP2018/084951, dated Mar. 8, 2019, 6 pages.

* cited by examiner

FIG.1
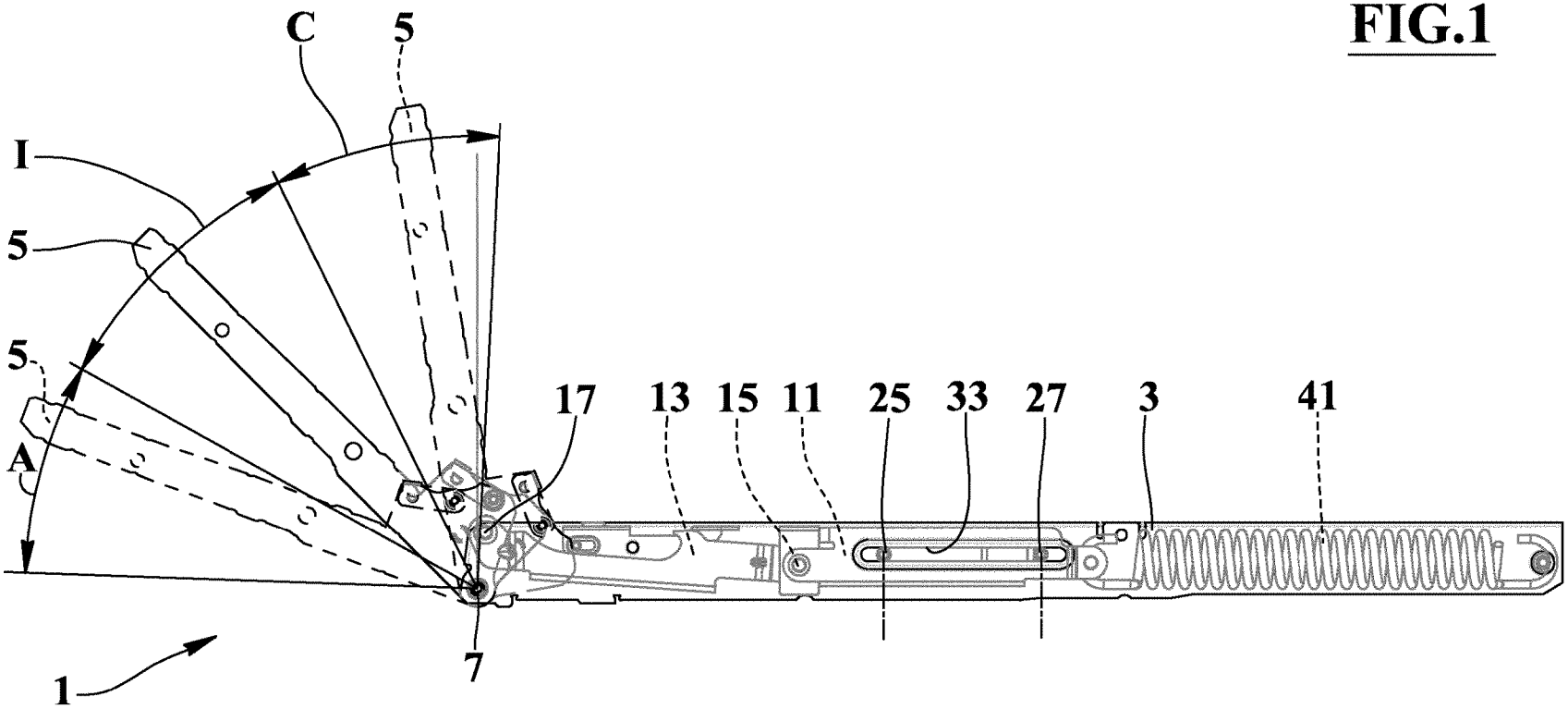
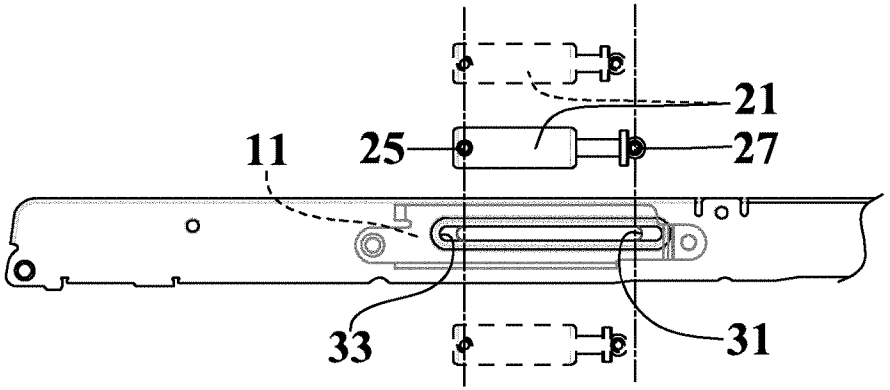
FIG.2

HINGE DEVICE WITH DAMPENING OF END STROKES

TECHNICAL FIELD

The present invention relates to hinges for household appliances, furniture, furnishings, equipment and the like and it refers to a hinge device with damping of the opening and closing end strokes.

BACKGROUND OF THE INVENTION

There are known appliances equipped with hinges provided with dampers which slow down the end portion of the opening or closing stroke of a door, hatch or leaf A drawback of such known devices is that they are unable to dampen both the final opening and closing strokes.

Another drawback consists in not allowing adjustment of the amplitude of the stroke section which is braked.

The prior art utility model n. DE 20 2007 012603 U1 (see U.S. Pat. No. 8,806,719) discloses a hinge device having foundational features in common with those disclosed herein and that are improved by the additional teachings hereof. The application n. EP 2 474 786 A2 provides general information in the technical field of this document.

DISCLOSURE OF THE INVENTION

An object of the present invention is to propose a hinged device with the possibility of damping either or both the end portion of the opening stroke and the end portion of the closing stroke of a door, hatch or leaf, closure and the like, even if only one damper is used.

Another object is to propose an easily configurable device for obtaining almost any dimension of the sections or of the individual section of damping of the door speed.

A further object is to propose a device which allows to activate and deactivate the braking effect in one or both the closing and opening end portions or to adjust the angular width of the portions in which the device slows down the door even after realization, for example during device assembly in an apparatus.

Another object is to propose a device suitable for vertical, horizontal and inclined doors with horizontal or vertical or inclined rotation axes.

Other objects are to propose a device fit for balancing the door and obtaining intermediate metastable positions of the door itself.

BRIEF DESCRIPTION OF THE DRAWINGS

The characteristics of the invention are shown below with particular reference to the attached drawings in which:

FIG. 1 shows a side view of the hinge device with damping of the end portions of the opening and closing strokes, that being an object of the present invention; to that end, a first element is fixable to the body of an apparatus and has a second element fixable to a door of the apparatus and illustrated with continuous line in one position at an intermediate door stroke and illustrated in dashed lines in two positions in two end portions of the opening and closing strokes respectively for opening and closing the door which, in these end portions of the opening and closing strokes, the door is slowed down by the hinge device;

FIG. 2 shows a side view of the first element of FIG. 1 and of a damping means or damper illustrated in continuous line and in dashed lines in its compression conditions corresponding to the positions of the second element in the intermediate stroke and in the opening and closing end portions of the opening and closing strokes;

BEST MODE TO CARRY OUT THE INVENTION

With reference to FIGS. 1-9, numeral 1 indicates the hinged device with damping of the end portions of the opening A and/or closing C strokes of a door of an apparatus object of the present invention.

The apparatus may consist of an appliance, a piece of equipment, a piece of furniture or any object equipped with closing and opening door or hatch.

The hinged device with damping comprises a first element 3 assigned to be fixed to a body or frame of the apparatus and a second element 5 assigned to be fixed to an access door inside said apparatus.

Figure 8:
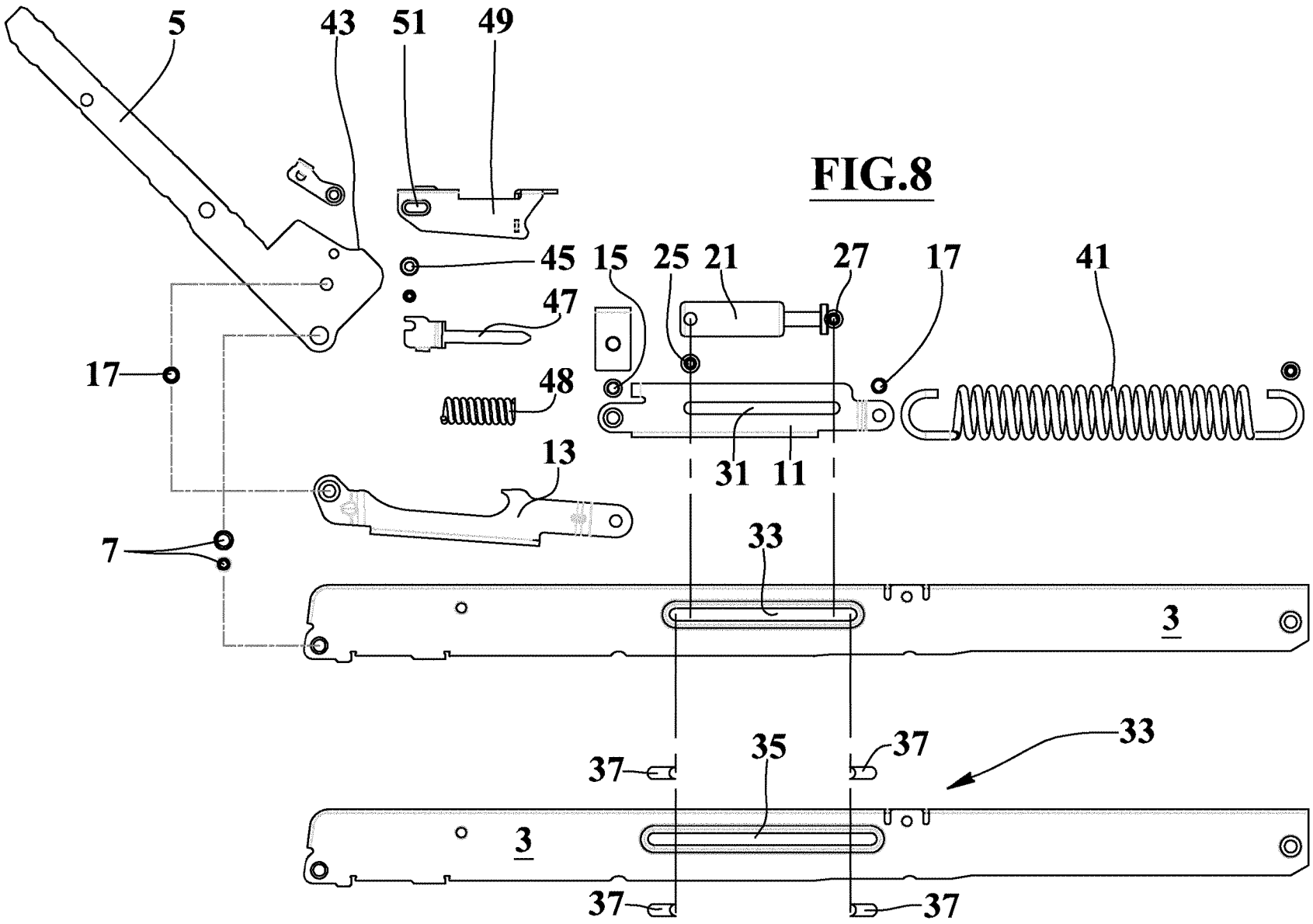
FIGS. 8 and 9 show exploded views, respectively in an orthogonal projection and in an axonometric view of the exploded device of FIG. 1 with FIG. 8 showing a variant of the first element of FIG. 1 at the bottom.
Figure 9:
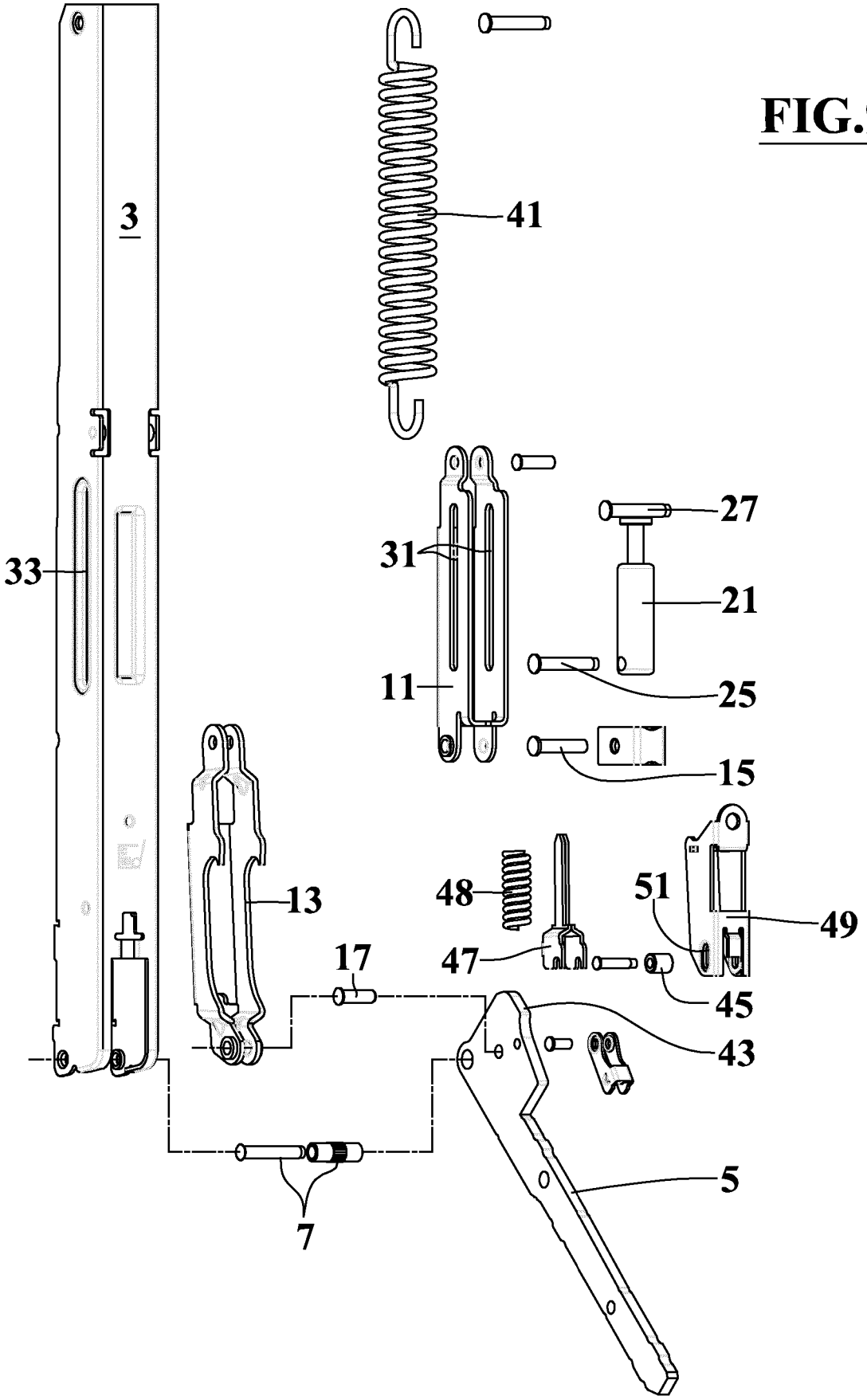

Said first element 3 and second element 5, in an assembled condition, are mutually connected by means of a hinge pin 7 for rotating the door about the hinge pin axis along the opening A and closing C rotation end stokes and along an interposed intermediate rotation stroke I. The hinge pin 7 may consist of a simple cylindrical pin or a cylindrical pin inserted into a bushing as shown in FIGS. 8 and 9.

The device function is to allow the door rotation by braking its stroke in the opening A and/or closing C end portions in a symmetrical or asymmetrical manner and for angular extensions selectable according to the requirements to which the device must conform.

The device 1 comprises a cradle or cradle means 11 sliding along or preferably within the first element 3 and a connecting rod or connecting rod means 13 whose ends are connected, by respective rotation pins 15, 17, one to the end closest to the rotation pin 15 of the cradle or cradle means 11 and the other to a portion of the second element 5 spaced from the hinge pin 7.

This connection between the cradle or cradle means 11 and the second element 5 made by the connecting rod or connecting rod means 13 causes the rotation of the door and of the second element 5 in the opening end strokes A, in the intermediate stroke I and in the closing end stroke C and causes corresponding translations of the cradle or cradle means 11 along the first element 3.

The cradle or cradle means 11 slidably houses a damping means or damper 21 of a linear type and moves it, at least partially, during its motion, along the first element 3, deriving from the door rotation.

The damping means or damper 21 has two parts, one sliding with respect to the other, so that the length of the damping means or damper 21 can vary from a minimum to a maximum to which it elastically tends due to the action of an internal or external elastic means or mechanism.

Each of said parts of the damping means or damper 21 is provided with a respective sliding member 25, 27 of the transverse pin type.

The cradle or cradle means 11 is provided with a pair of first slots 31 mutually facing and spaced apart and the first element 3 is provided with a pair of second slots 33 each parallel and adjacent to a respective first slot 31.

Each end of each sliding member 25, 27 slides into a first slot 31 of the cradle or cradle means 11 and into the adjacent second slot 33 of the first element 3.

The longitudinal extension of the second slots 33 is at least equal to or preferably greater than the longitudinal extension of the first slots 31 but the invention also provides the opposite alternative possibility.

In the intermediate I portion of the stroke of the door, hatch or leaf, the damping means or damper 21 is at its maximum length or nearly so and the sliding members 25, 27 of its parts are in contact or almost with the ends of the first slots 31 of the cradle means 11 and said sliding members 25, 27 slide into the second slots 33 of the first element 3 or, alternatively, vice versa.

In the end portion A of the door opening stroke and the end portion C of the door closing stroke, one of said sliding members 25, 27 is in contact with one end of the first slots 31 and the other member 27, 25 is in contact with one end of the second slots 33 of the first element 3. In such conditions occurring during the opening A and closure C end strokes, the door rotation respectively in the opening and closing direction causes the cradle means to slide into the corresponding reciprocal approach of the sliding members 25, 27 and the consequent compression of the damping means 21 which causes the door rotation speed to be damped in said opening A and closing C end strokes. This also occurs in the alternative case mentioned above.

For the device operation reducing the door speed in the opening A and/or closing C end strokes, precise or predetermined positioning or sizing are not indispensable but it is sufficient the happening of the compression, or the shortening, of the damping means or damper 21 during such opening A and/or closing C end stokes.

In the embodiment shown, the length of the first slots 31 of the cradle or cradle means 11 corresponds to the maximum distance between the sliding members 25, 27 in the maximum length condition of the damper or damping means 21 and the length of the second slots 33 of the first element 3 is equal to the sum of the length the first slots 31 with the translation length of the cradle or cradle means 11 in the door intermediate stroke I.

In an alternative case the relations between the lengths are reversed.

Preferably, for a symmetrical braking effect in the opening A and closing C end strokes, the distance between the hinge pin 7 and the rotation pin 17 of the connecting rod or connecting rod means 13 to the second element 5 is determined so that the translation length of the cradle or cradle means 11 in the door opening A and closing C end strokes correspond at least approximately to the damper or damping means 21 excursion, or to the difference between the maximum and the minimum of the length of the damper or damping means 21. Moreover the length the connecting rod or connecting rod means 13 and/or the longitudinal position of the second slots 33 is determined such that in the hatch, door, or leaf opening and closing end conditions, the damping means 21 is at its minimum length. As seen such dimensions, positions and ratios are not indispensable for the operation of the device which can be made for asymmetric damping or only in one of the opening or closing end strokes.

Returning to the illustrated embodiment, the opening and closing end strokes have an angular extension between about 10° and about 35° while the intermediate stroke has an angular extension ranging between about 70° and about 20°.

The linear damper or damping means 21 is preferably of a viscous fluid type, for example mineral oil, and a part thereof consists of a cylinder and the other part in a sliding piston which is not perfectly sealed in the cylinder lumen and has a rod protruding from the cylinder. The cylinder carries a transverse opening or seat for the respective sliding member 25 and the protruding rod free end, that is opposite to the piston and external to the cylinder, carries the respective sliding member 27; preferably this last sliding member 27 is rigidly and transversely fixed to the protruding rod free end.

The opposite ends of each cylindrical pin of such sliding members 25, 27 are widened to prevent their disengagement from the slots 31, 33.

The cylinder of the damping means 21 contains, in addition to the oil, a spring or an elastic spring means compressed between the cylinder top and the piston and intended for the elastic return of the piston and the rod in the most protruding position of the latter corresponding to the maximum length of the damping means 21.

Figure 4:
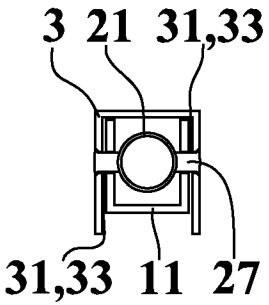
FIG. 4 shows a schematic and sectional view according to the plane IV-IV of FIG. 3.
Figure 3:
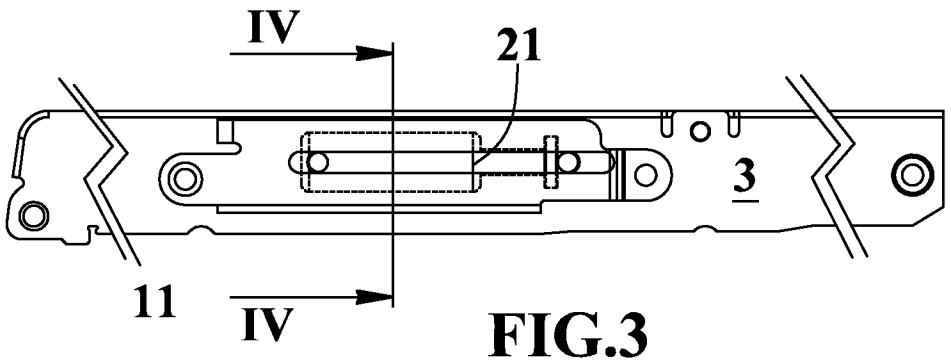
FIG. 3 shows a partial and enlarged view of a detail of FIG. 1.
Figure 7:
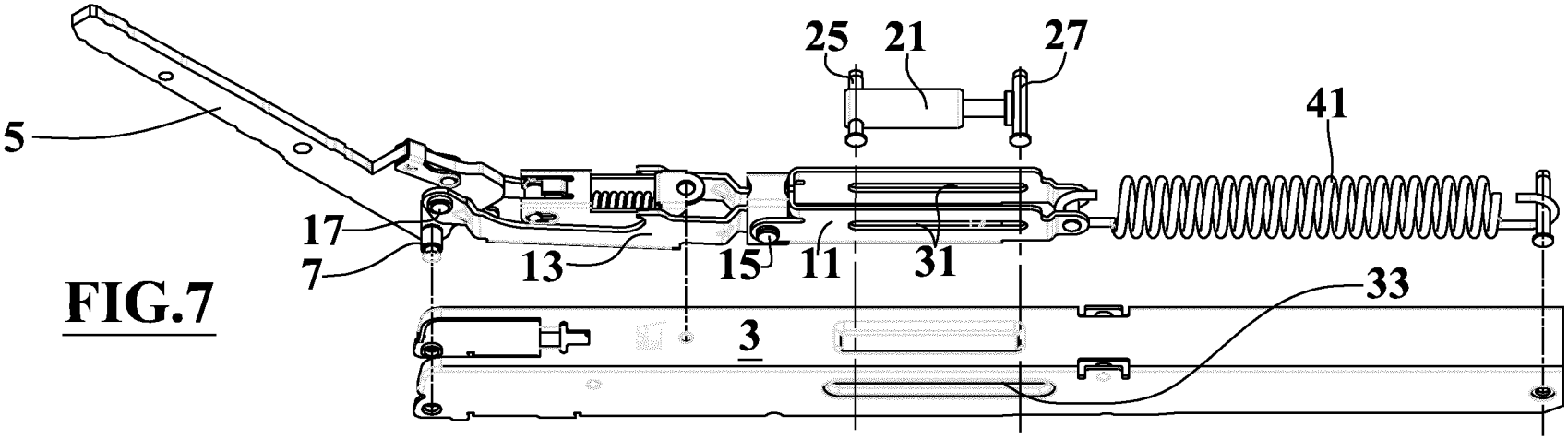
FIGS. 5-7 show axonometric views of the device of FIG. 1 in assembled conditions and progressive disassembly.
Figure 5:
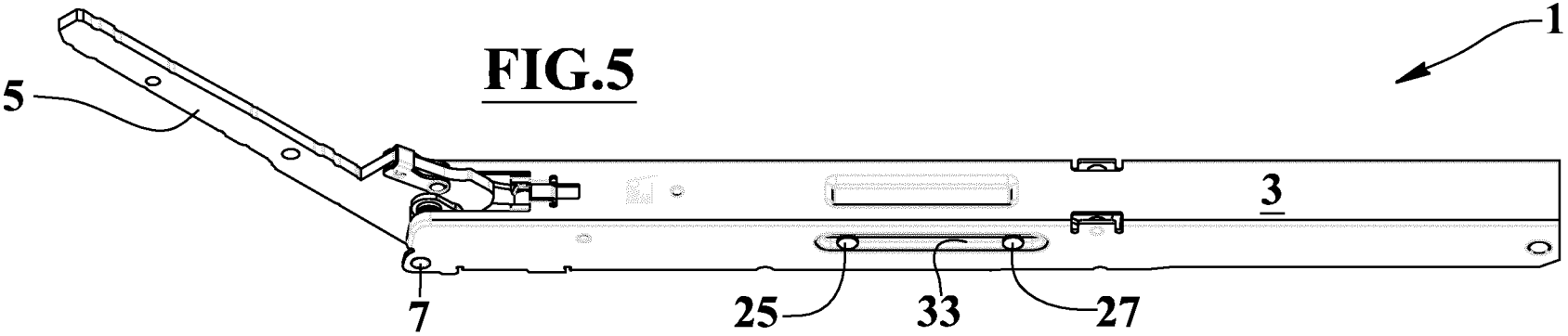
Figure 6:
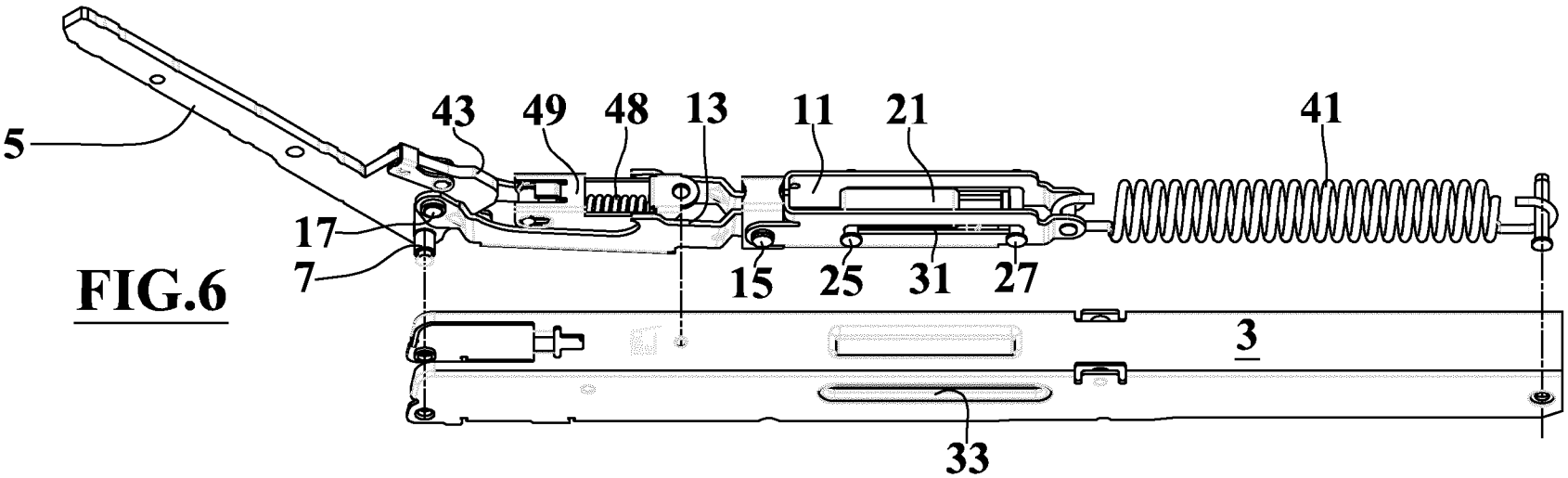

The first element 3 and the cradle means 11 are made of die-cut and die-bent metal sheet and, as illustrated in FIG. 4, the respective cross sections are in a squared "U" shape. The damping means 21 is slidably housed in the U-shaped cavity of the cradle means 11 which, in turn, is slidably housed in the U-shaped cavity of the first element 3.

The first and second slots 31, 33 are formed in the mutually facing and parallel longitudinal walls of the cradle means 11 and the first "U" element 3 respectively.

The device 1 comprises a helical spring 41 operating under tension and whose ends are fixed, for example by pins and/or hooks, to end portions of the cradle means 11 and of the first element 3 opposite to the hinge pin 7. This helical spring 41 transmits to the second element 5 and to the door, by means of cradle means 11 and rod means 13, a balancing force for the door weight directed in the closing direction.

A portion of the second element 5 adjacent to the hinge pin 7 has an edge 43 in the form of a shaped cam and the device 1 comprises a roller or roller means 45 pressed against this edge 43 by its elastic thrust means. During the door rotation, the roller or roller means 45 rolls along said cam edge 43 transmitting to the door thrust or stabilization forces for metastable positioning of the door in intermediate, closing and/or opening positions.

Moreover, the device comprises a guide or guide means 47 designed to support the rotation axis of the roller or roller means 45 and to transmit the elastic force of the elastic thrust means consisting of a helical spring 48 compressed between guide means 47 and a projection or shelf of a support or support means 49 which contains the guide means 47 and the helical spring 48 themselves.

Said support means 49 is fixed in the first element 3 and is provided with sliding slots 51 for the rotation axis of the roller or roller means 45 allowing the latter to carry out the excursions necessary to follow the profile of the edge 43 in the form of a shaped cam.

The connecting rod means 13 is made of die-cut and die-bent metal sheet and is of open box-like shape with an inner cavity which partially houses the support means 49.

The operation of the device is that the compression and shortening of the damping means in the opening A and/or closing C end strokes of the door causes a slowing down of the opening and/or closing speed of the door itself In the variant of the first element 3 shown at the bottom of FIG. 8, it is provided that the second slots 33 comprise respective through grooves 35 of such length so that their ends do not meet with the sliding members 25, 27 in one or both the opening A and closing C end strokes and furthermore comprise a set of end-stop means 37, all the same or also of different lengths, which can be fixed and removed from the ends of said grooves 35 to activate or deactivate the rotational speed damping in the opening A and closing C end strokes and/or for determining the angular extensions of such end strokes A, C in which said damping takes place.

The invention claimed is:

1. Hinge device with dampening of an end portion of an opening stroke, an end portion of a closing stroke, or both the end portion of the opening stroke and the end portion of the closing stroke of a door of an appliance, and comprising a first element fixable to a body of the appliance and a second element fixable to the door of the appliance, where the first and second elements, in an assembled condition, are mutually connected by means of a hinge pin for the rotation of the door along the end portions of the opening and closing strokes and along an interposed intermediate portion of the opening and closing strokes of the door around a rotation axis of the hinge pin; the device comprises a cradle for sliding along or within the first element, and a connecting rod having an end connected by a respective rotation pin to the cradle and another end connected by a respective rotation pin to the second element, such that the rotation of the second element in the end portion of the opening stroke, in the intermediate portion of the opening and closing strokes of the door, and in the end portion of the closing stroke, causes corresponding translations of the cradle which slidably houses a linear damper having two parts that are slidable with respect to each other, such that length of the damper may vary from a minimum length to a maximum length, at which it elastically stretches as a result of the action of an internal or external elastic component; wherein each of the parts of the linear damper is provided with a respective sliding member each having an end for sliding in first slots of the cradle and in second slots of the first element, wherein in the assembled condition each of the first slots of the cradle is aligned face-to-face with a corresponding slot of the second slots of the first element, wherein the second slots have a longitudinal extension at least equal to or greater than that of the first slots with which they are face-to-face in the assembled condition; wherein the intermediate portion of the stroke of the door, the damper is at its maximum or substantially maximum length, and the sliding members of its parts contact or substantially contact ends of the first slots of the cradle and such sliding members slide in the second slots of the first element; in the end portions of the opening and closing strokes of the door, one of the sliding members is in contact with one end of the first slots and the other is in contact with one end of the second slots of the first element and the rotation of the door in the opening and closing direction causes the cradle to slide with respect to the first element in the corresponding direction of mutual approaching of the sliding members and the consequent compression of the damper, that causes rotational speed of the door to slow down in the end portions of the opening and closing strokes.

2. The hinge device according to claim 1, wherein a length of at least one of the first slots of the cradle corresponds to a maximum distance between the sliding members in the condition where the damper is at its maximum length, and the length of the second slots of the first element equals the sum of the length of the first slots with the length of the translation of the cradle in the intermediate portion of the stroke of the door; the distance between the hinge pin and the rotation pin connecting the connecting rod means to the second element is determined such that the length of the translations of the cradle in the end portions of the opening and closing strokes of the door correspond at least approximately to the excursion of the damper, i.e., to the difference between maximum and minimum values of length of the damper; the length of the connecting rod and/or the longitudinal position of the second slots are determined such that in extreme opening and closing conditions of the door, the damper is at its minimum value of length.

3. The hinge device according to claim 1, wherein the linear damper is of a viscous fluid type and one part thereof consists of a cylinder and the other part thereof of a piston provided with a rod projecting from the cylinder, which carries a seat for the respective sliding member, and a free end of the projecting rod carries the respective sliding member, where the sliding members consist of cylindrical pins with enlarged ends to prevent them from disengaging the slots of the cradle and the first element; the cylinder contains the elastic component in the form of a helical spring for elastic return of the piston to the maximum length of the damper.

4. The hinge device according to claim 1, wherein the second slots comprise respective pass-through grooves of such a length that their ends do not match the sliding members in either one or both end portions of the opening and closing strokes, and comprise a set of end-stop means that are fixable or removable from ends of the grooves to activate or deactivate the damping of the rotational speed in the end portions of the opening and closing strokes, or to determine the angular extensions of these end portions of the strokes in which the damping takes place, or both.

5. The hinge device according to claim 1, wherein the first element and the cradle are made of die-cut and die-bent metal sheet and respective cross-sections thereof are in the shape of a squared U-shaped cavity, where the damper is slidably housed in the U-shaped cavity of the cradle that is slidably housed in the U-shaped cavity of the first element.

6. The hinge device according to claim 5, wherein the first and second slots are obtained from face-to-face parallel longitudinal walls of the cradle and of the first element, respectively.

7. The hinge device according to claim 1, further comprising a helical spring operating under tension comprising ends that are fixed to end portions of the cradle and of the first element, opposite to the hinge pin.

8. The hinge device according to claim 1, wherein one portion of the second element adjacent to the hinge pin has an edge in the form of a shaped cam, and in that it comprises a roller pressed to roll on the cam edge, whereby during the rotation of the door the roller rolls along the cam edge and transmits thrust or stabilizing forces to the door for metastable positioning of the door in any of intermediate, closing, or opening positions.

9. The hinge device according to claim 8, further comprising a guide for supporting a rotation axis of the roller and for transmitting thereto an elastic force of a helical spring compressed between the guide and a support bearing the guide and the helical spring; wherein the support is fixed in the first element and is equipped with sliding slots for the rotation axis of the roller.

10. The hinge device according to claim wherein the connecting rod is made of die-cut and molded metal sheet, and is in the shape of an open box, with an internal cavity partially housing the support.

* * * * *